US011578455B2

(12) United States Patent
Matros

(10) Patent No.: US 11,578,455 B2
(45) Date of Patent: Feb. 14, 2023

(54) MOBILE FIREFIGHTER GEAR CLEANER

(71) Applicant: HC Risk Reduction, LLC, Marlborough, MA (US)

(72) Inventor: Michael Matros, Marlborough, MA (US)

(73) Assignee: HC Risk Reduction, LLC, Marlborough, MA (US)

( * ) Notice: Subject to any disclaimer, the term of this patent is extended or adjusted under 35 U.S.C. 154(b) by 159 days.

(21) Appl. No.: 16/919,487

(22) Filed: Jul. 2, 2020

(65) Prior Publication Data

US 2021/0002814 A1 Jan. 7, 2021

Related U.S. Application Data

(60) Provisional application No. 62/870,405, filed on Jul. 3, 2019.

(51) Int. Cl.
*D06F 95/00* (2006.01)
*D06F 17/12* (2006.01)
(Continued)

(52) U.S. Cl.
CPC ..... *D06F 95/00* (2013.01); *D06F 17/12* (2013.01); *D06F 19/00* (2013.01); *D06F 29/005* (2013.01);
(Continued)

(58) Field of Classification Search
CPC ..... D06F 95/00; D06F 17/12; D06F 19/00; D06F 29/005; D06F 33/57; D06F 35/001;
(Continued)

(56) References Cited

U.S. PATENT DOCUMENTS 6,627,053 B2 * 9/2003 Hirota ..... C02F 1/4674 204/228.1
2006/0273041 A1 * 12/2006 Maddox ..... C02F 1/34 210/748.03

(Continued)

FOREIGN PATENT DOCUMENTS

CN 105150909 A * 12/2015
WO WO-9710376 A1 * 3/1997 ..... A47L 15/4295

OTHER PUBLICATIONS

NPL-1 Crest Ultrasonics https://crest-ultrasonics.com/ultrasonic-parts-cleaner-washer/ (Year: 2013).*
NPL-2 Omegasonics https://www.omegasonics.com/product/30-micron-disposable-filter/ (Year: 2015).*
NPL-3 Q-spray baffles https://www.qspray.com/surgebusters-mini-tank-baffles/ (Year: 2016).*

(Continued)

*Primary Examiner* — Michael E Barr
*Assistant Examiner* — Pallavi Chitta
(74) *Attorney, Agent, or Firm* — McHale & Slavin, P.A.

(57) ABSTRACT

A mobile vehicle that is self-contained and equipped to wash firefighter gear at the firefighter's station. The vehicle would be on a dispatched network and be activated after an incident, and for scheduled cleanings on a regular basis; the vehicle having the required equipment to clean all contaminated gear by use of a sonic cleaner, extractors, dryers, and an ozonator. The process includes monitoring the life of the gear and decontaminating the gear in accordance with the gear manufacturer's recommendations. Gear that has been cleaned is reassembled, wrapped, sealed and placed back into a fireman's station, giving the firefighter the assurance that their firefighting gear was cleaned, sanitized, and serviced per the manufacturer's recommendations.

15 Claims, 1 Drawing Sheet

(51) Int. Cl.

| | |
|---|---|
| ***D06F 35/00*** | (2006.01) |
| ***D06F 29/00*** | (2006.01) |
| ***D06F 59/02*** | (2006.01) |
| ***D06F 33/57*** | (2020.01) |
| ***D06F 19/00*** | (2006.01) |
| *D06F 93/00* | (2006.01) |

(52) U.S. Cl.
CPC ..... *D06F 33/57* (2020.02); *D06F 35/001* (2013.01); *D06F 59/02* (2013.01); *D06F 93/00* (2013.01)

(58) Field of Classification Search
CPC ..... D06F 59/02; D06F 93/00; D06F 35/004; D06F 39/007; D06F 58/203; D06F 58/10
See application file for complete search history.

(56) References Cited

U.S. PATENT DOCUMENTS

2008/0060955 A1* 3/2008 Goodnow ..... A61B 5/0024 206/370
2014/0026971 A1* 1/2014 Roach ..... C25B 15/08 204/229.8

OTHER PUBLICATIONS

NPL-4a extractor https://www.milnor.com/products/30015t6x/ (Year: 2015).*
NPL-4b Tumble dryer https://www.milnor.com/products/m30v/ (Year: 2014).*
NPL-4c Hanger dryer https://www.milnor.com/products/fc-3/ (Year: 2014).*

* cited by examiner

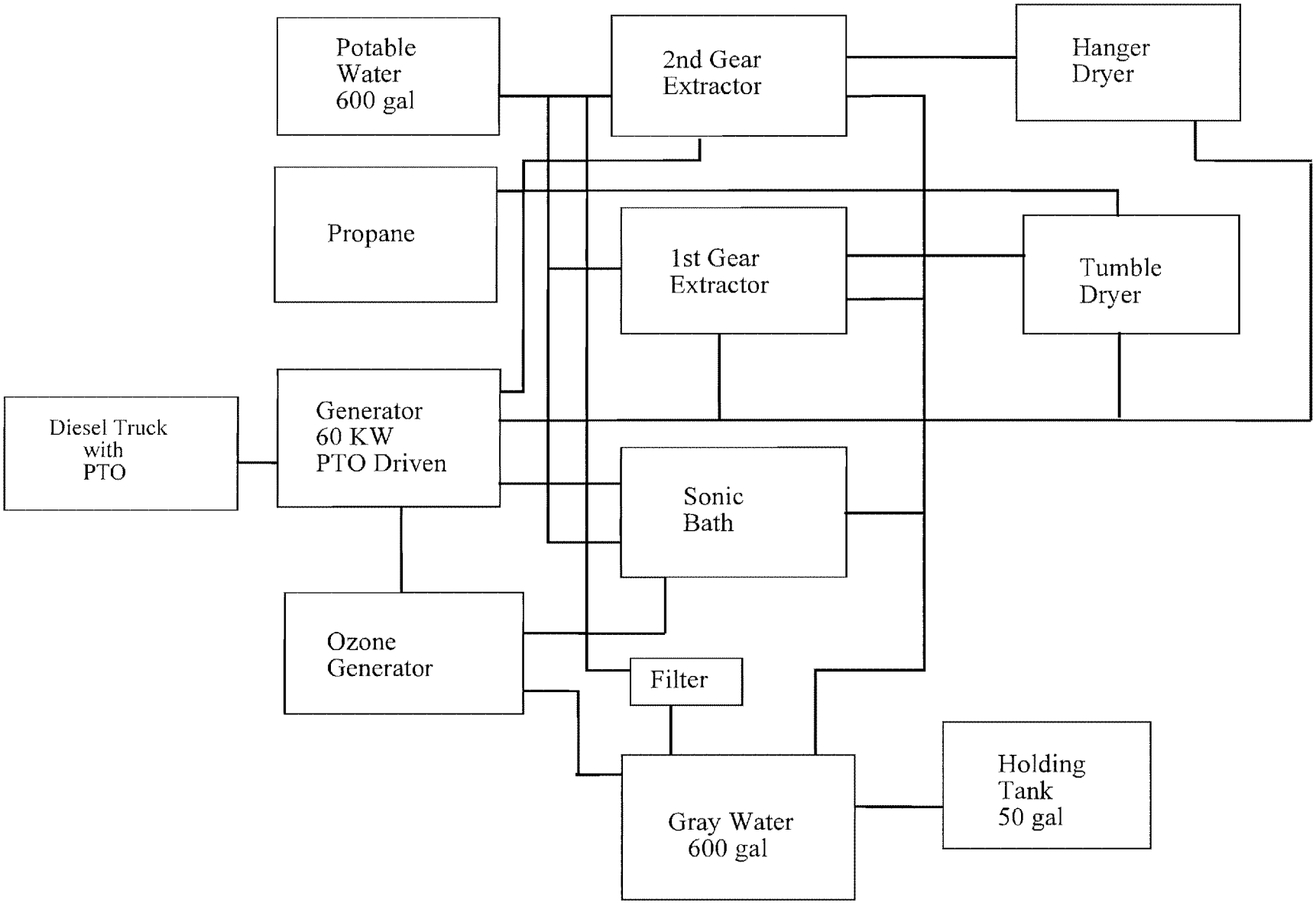
Hanger Dryer
Tumble Dryer
Holding Tank 50 gal
2nd Gear Extractor
1st Gear Extractor
Sonic Bath
Filter
Gray Water 600 gal
Potable Water 600 gal
Propane
Generator 60 KW PTO Driven
Ozone Generator
Diesel Truck with PTO

MOBILE FIREFIGHTER GEAR CLEANER

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/870,405, entitled "MOBILE FIREFIGHTER GEAR CLEANER", filed Jul. 3, 2019. The contents of which the above referenced application is incorporated herein by reference.

FIELD OF THE INVENTION

This invention is directed to the field of equipment cleaning and, in particular, to a mobile firefighter gear cleaner.

BACKGROUND OF THE INVENTION

Recently firefighter turnout gear has been directly linked to occupational cancer. Firefighters are the first responders to any type of fire, wherein they can be exposed to high levels of toxic matters. A basic forest fire is known to produce toxic particulate matter. A complex warehouse fire containing plastics may release toxic dioxins and furans. The toxic matter may coat every aspect of the firefighter gear. Firefighters are 68% more likely to develop cancer than the general population. Contaminated firefighting gear, namely jackets and pants, were once recognized as a badge of honor. Now the fire service recognizes that soiled or contaminated protective garments can expose firefighters to toxins and carcinogens released by the fire and deposited upon the firefighter gear. Firefighter gear is so contaminated that anyone near the firefighter can be exposed to the toxins and carcinogens. Such gear can cause the spread of communicable disease. Contaminated gear further puts the firefighters at risk, as contaminated gear can absorb radiant heat, conduct electricity, and can be flammable.

Manufactures of firefighter gear recognize the risk of wearing dirty turnout gear. NFPA 1851 states that firefighter gear should be cleaned and inspected at least two times per year. Manufacturers state that gear should be cleaned and inspected every six (6) months, and after every exposure.

There are many problems the fire service faces in order to abide by the above referenced standards. All known gear cleaning machines are extremely expensive considering installation, service, and operating requirements. Further, gear cleaning machines take up valuable space in an already tight firehouse. In addition, gear needs to be cleaned and properly put back together to manufacturer recommendations, which requires training. The average gear cleaning machine can wash 2-4 sets of gear at a time. A typical fire has 16-20 firefighters on the scene, which means it would take 16-20 hours to clean this gear after a single exposure. Once the gear is cleaned, there may or may not be required to prepare maintenance records to fulfill NFPA 1851 requirements. There are many problems that come with firefighters cleaning their own gear; the major ones being cleaning requirements, logistics, and costs. When working, firefighters need their gear, and a typical fire station cannot expect the firefighter to clean their gear while on duty.

In addition to a regular maintenance program, gear is also to be cleaned after a fire, hazmat incident, prolonged use, after exposure to blood or other infectious diseases. Many municipalities, other nonprofits, unions, and corporations know the problem of contaminated gear, and how it substantially increases the risk of toxic exposure to the firefighter and those who come in contact with the firefighter.

While the solution would suggest that the gear is simply cleaned after each fire, or on a regular basis, some problems with such a solution is that: 1) gear extrication equipment can surpass $45,000 per fire station, and most municipalities have multiple stations and are considered underfunded; 2) the equipment to properly extract carcinogens from firefighter gear takes a significant amount of space, and most fire stations cannot be retrofitted to hold the required cleaning equipment; 3) the proper time to clean gear is following a fire, wherein the firefighters are exhausted, leaving the gear to contaminated the fire station; 4) average gear extractors that can fit in a firehouse can wash 2-3 sets of gear at a time, and could take about 2 hours to complete. The problem with this is that at a fire there should be a minimum of sixteen (16) firefighters, and all gear should be cleaned in a timely manner. At this rate, it would take sixteen (16) hours to clean the gear in their current system, exposing the public to harm should a fire call occur and the firefighters do not have their gear back from cleaning; 5) firefighters have limited training on proper cleaning techniques, how to know when equipment is properly cleaned, and required manufacturer's recommendations.

What is needed in the industry is a mobile cleaning unit specifically designed to meet firefighter gear decontamination requirements in a cost efficient and timely manner.

SUMMARY OF THE INVENTION

Disclosed is a system designed to clean firefighter gear in an effective and efficient manner by use of a mobile vehicle that provides for the cleaning and sanitizing of gear at the firefighter's station. The mobile vehicle would allow 20-40 sets of gear to be cleaned in a firehouse parking lot in roughly three (3) hours, as opposed to being sent out, which takes 2-3 weeks. The apparatus will wash, dry, sanitize and track all firefighter PPE, personal protection equipment, including helmets, jackets, pants, boots, gloves, hand tools, and SCBA equipment. In a preferred embodiment, gear is inspected, placed in a sonic wash, directed through a commercial gear extractor, and air dried from the inside out using low heat and high air velocity.

The disclosed apparatus is a mobile extraction unit comprising a mobile vehicle equipped with the ability to wash sets of gear using a specific organization of equipment. The mobile vehicle would be part of a dispatched network and be activated after an incident, and for scheduled cleanings on a regular basis. The mobile vehicle would show up after a fire and after firemen come off duty. All contaminated gear is taken through the mobile vehicle, where it is washed and dried in accordance with the manufacturer's recommendations. Gear would be properly put together, wrapped and sealed and ideally placed back into the fireman's locker. When the firefighter returns to duty, they have the assurance of knowing their gear was cleaned and sanitized in accordance with the manufacturer's requirements. The mobile vehicle is defined to be a dedicated truck capable of hauling the recommended equipment, or a trailer having all components described herein and capable of being pulled by a truck.

Key equipment includes a scannable computer system that both tracks a maintenance log for all gear, as well as files a condition report after every use; an ultra sonic washing station that applies a presoak to PPE and also cleans boots, helmets, and hand tools; a commercial extractor provides specialized washing system to clean personal protective gear such as jackets, pants, and liners through a deep wash cycle that is specially engineered to handle 5-7 sets of turnout gear; commercial drying cabinets which use high velocity air and mild heat to dry turn out gear, gloves, boots, and helmets from the inside out to assure fabric stays strong and does not breakdown; and ozone gas treatment to kill 99.9% of all bacteria. This treatment is applied to the gear during the wash cycle by displacement of air with ozone. Ozone destroys bacteria or mold and can be used for both hard items as well as fabrics. Potable water tanks that can be pressurized to deliver clean water to the washing machines with a 600-gallon capacity. The truck also has a gray water tanks with a 600 gallon capacity for proper disposal of contaminated water and no cross contamination.

An objective of the instant invention is to provide a mobile gear cleaner that will maintain the firefighter gear in a condition that gives a fireman the protection needed as they service the community to protect the lives of others.

Another objective of the instant invention is to provide a mobile gear cleaner for use by certified cleaning experts trained to follow manufacturer recommendations in maintaining firefighting gear.

Still another objective of the instant invention is to provide: a program that assures all gear is cleaned on a regular basis, as well as after an incident; a program cost that is significantly less than the cost to outfit every station with the proper equipment; that assures all contaminated equipment is thoroughly cleaned, inspected, and placed back into service; that meets NFPA 1851 requirements (1851, n.d.); that prevents contaminated fluids from going into community sewage systems; and assures all gear (helmets, hoods, jackets, pants, boots, gloves, and hand tools) are properly cleaned and serviced by providing a standard operating procedure that is both effective and easy to enforce.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

BRIEF DESCRIPTION OF THE DRAWINGS

FIG. 1 is a block diagram of the mobile cleaning apparatus of the instant invention.

DETAILED DESCRIPTION OF THE PREFERRED EMBODIMENT

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Disclosed is a firefighter gear cleaner apparatus comprising a mobile vehicle 10 having a footprint of about 96" wide and 24' long. The mobile vehicle is self contained with all equipment operating from the truck PTO operated 60 KW generator and propane tank heater. The mobile vehicle is defined to be a dedicated truck capable of hauling the recommended equipment, or a trailer having all components described herein and capable of being pulled by a truck. The vehicle is particularly designed to address the equipment used by a firefighter with equipment arranged so as to eliminate cross contamination but allow immediate cleaning of the various firefighters equipment employed. The vehicle includes a potable water tank and a gray water tank. A sonic bath first receives gear to be cleaned. The sonic bath is constructed and arranged to receive a mixture of about 90% water and 10% cleaning solution, and used to loosen particles from the gear, including boots, helmets, hand tools, air packs, and the like firefighter gear. A first gear extractor is coupled to the sonic bath for receipt of gear including, but not limited to, a firefighter inner wear, not shown. The first gear extractor is constructed and arranged to provide cleaning specific to the inner wear, jacket liner, and the like. A first dryer is used for receipt of gear from the first extractor; the first dryer is in the form of a tumbler dryer with a heater fueled by propane secured to the vehicle in a preferred embodiment, an electric heater may be used as an alternative.

A second gear extractor is constructed and arranged to provide cleaning specific to the jacket shell. The second dryer is used for receipt of the jacket and employs a cabinet for receipt of the jacket shell employing low heat and high velocity air for drying. The first gear extractor and the first dryer are separate from the second gear extractor and the second dryer to prevent cross contamination. An ozonator is used for injecting a predetermined amount of ozone into extractors to displace air in the extractors. The dryers allowing the simultaneous drying of gear while maintaining a physical separation so that the inner wear is not subjected to contamination that comes from the outerwear such as the jacket. The ozone is used in an amount sufficient to destroy odors and living bacteria.

The process of cleaning and inspecting gear comprises the steps of:

Step 1: Preliminary decontamination of all gear is performed outside of vehicle prior to cleaning—this is done through washing and rinsing with clean water.

Step 2: Gear is taken in and inventoried through a detailed barcode system. Every glove, boot, jacket, liner, pair of pants, helmet, hood, and hand tool is taken in and inventoried in a custom database. The database tracks all data based upon barcodes imbedded and pressed into the gear. The database monitors the user, condition, regular maintenance, inspection reports, and exposure reports. Reports can be generated by firemen or by the entire department. Barcodes are imbedded to withstand the lifetime of the gear.

Step 3: Gear is placed in a mesh bag to keep together. Bags are numbers and assigned to an individual.

Step 4: Gear is placed in a sonic cleaning bath for removal of gross contaminants. The sonic cleaning bath utilizes microscopic bubbles to clean PPE and hand tools. This step takes about 10 minutes and is used to clean critical equipment that is unable to be cleaned in extractors, requiring 100 gallons, 90 gallons of water and 10 gallons of specialized cleaning solution.

This process takes 10 minutes and uses a mixture of 90% water and 10% cleaning solution. This specially designed tank is large enough to fit gear, boots, helmets, hand tools, air packs, and or other firefighter gear. It uses microwaves to loosen any particles and make the cleaning process easy and effective, while causing no damage to any material. This is designed to private a second level of decontamination and requires no rotation. The microscopic bubbles loosen debris and gently clean the fabrics and materials; is safe on all materials from soft fabrics to hard metals.

Step 5: Gear is placed in a commercial gear extractor and given a deep cleaning. In the preferred embodiment there are at least two extractors, one for the interior jacket liners and one for the outer jacket shell, so the gear is washed independently and will not cross contaminate each other. The gear extractors are heavy duty commercial grade washers designed to extract the carcinogens that are imbedded in turn out gear. This requires a special process that is both gentle of gear and tough on dirt, bacteria, and carcinogens. Machines require 30 gallons of water per load. This is for the liners and the outer layers to be washed independently in about 30 minutes.

Step 6: Gear is removed from the extractors and placed in a drying cabinet constructed and arranged to permit the gear to be dried from the inside out. This process uses low heat and high velocity air in a sealed cabinet to properly dry gear in about 2 hours. Gear is placed within the cabinet to prevent sun exposure and maintain a control of temperatures. The drying cabinets can be placed on wheels, which allow the dryers to be moved around during the drying process.

Step 7: Gear is subjected to an ozone application to kill any bacteria and mold. Ozone eliminates odors as well as bacteria, mold, or living organisms. The ozone application is also used on gear that cannot be machine washed, such as a helmet, boots, harness, or air pack. The ozonator allows treatment of helmets and boots, as well as adds another level of protection, killing off any remaining bacteria. In the preferred embodiment there are four (4) units on board, and a cycle takes about 2 hours; alternatively, a single unit can be used to feed ozone to particular units.

Step 8: Gear is inspected and matched to the inventory database with a maintenance log. The maintenance log goes into a permanent database and tracks gear throughout the lifetime of the gear, regardless of the person assigned to that gear. A complete customer database and scanning computer program for information tracking meets NFPA 1851 requirements.

Step 9: Gear is reassembled by certified technicians. This is a critical function, as gear has to be properly placed back together.

Step 10: Gear is placed in an air tight bag for the end user. This allows gear to be stored and have no contamination or damage during the storage process.

Step 11: Gear is placed back in service.

The firefighter gear cleaner system comprises a mobile vehicle having a PTO. An electrical generator is secured to the mobile vehicle and coupled to the PTO. A potable water tank is secured to the mobile vehicle, the water tank transfers potable water under pressure and is tested by a detection sensor to calculate pH, chlorine, and hardness level. A sonic bath tank secured to the mobile vehicle and fluidly coupled to the portable water tank. The sonic bath tank having a water tight lid to allow transport without loss of fluid. The sonic bath tank includes a recirculation pump and a 30 micron filter. The sonic bath tank includes removable baffles that allow transporting while fluid in the tank, yet allows ease of removal when in use. The sonic bath tank is filled with 90% portable water admixed with about 10% cleaning solution, the sonic bath tank constructed and arranged to clean hard surfaced firefighter gear such as boots, helmets, hand tools and air packs.

An ozone generator secured to the mobile vehicle and electrically coupled to the generator with ozone injected into the sonic bath tank through a bubbler unit positioned along the bottom of said sonic bath tank.

A first gear extractor is secured to the mobile vehicle and is electrically coupled to the generator and fluidly coupled to the potable water tank with a first insertion pump coupled to the detection sensor to calculate the amount of cleaner material to be inserted based upon said calculated pH, chlorine, and hardness level of the potable water A tumble dryer sized to receive gear treated in the first gear extractor, the tumble dryer and a propane tank is used to fuel a heater secured to the mobile vehicle. The first gear extractor and said tumbler dryer are constructed and arranged to wash and dry the inner liners of said firefighter gear. The first insertion pump is coupled to said detection sensor by Bluetooth.

A second gear extractor secured to the mobile vehicle, electrically coupled to the generator and fluidly coupled to the potable water tank with a second insertion pump coupled to the detection sensor to calculate the amount of cleaner material to be inserted based upon said calculated pH, chlorine, and hardness level of the potable water. Air in the first and second extractor is displaced with ozone from the ozone generator.

A hanger dryer secured to the mobile vehicle is used to receive the material from the second gear extractor. The hanger dryer employs a heater electrically coupled to the generator to provide low heat with a high velocity air flow through the dryer. The second gear extractor and hanger dryer are constructed and arranged to wash and dry the outer wear of firefighter gear, namely the firefighter jacket. The hanger dryer is about 6 feet wide, 7 feet tall, and 3 feet deep and arranged to receive firefighting gear on a hanger.

A gray water tank is secured to the mobile vehicle and fluidly coupled to the sonic bath tank, the first extractor and the second extractor. The gray water tank is also coupled to the ozonator and a filter is used to allow recycling of the fluid inserted through the sonic bath tank, the first extractor and the second extractor.

A holding tank secured to the mobile vehicle and fluidly coupled to the gray water tank. The holding tank holds contaminated fluid received from said gray water tank. The potable water tank holds about 600 gallons of fluid. The gray water tank holds about 600 gallons of fluid and includes an ozone bubbler unit secured to the bottom of the gray water tank. The holding tank holds about 50 gallons of contaminated fluid.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The term "coupled" is defined as connected, although not necessarily directly, and not necessarily mechanically.

The use of the word "a" or "an" when used in conjunction with the term "comprising" in the claims and/or the specification may mean "one," but it is also consistent with the meaning of "one or more" or "at least one." The term "about" means, in general, the stated value plus or minus 5%. The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

What is claimed is:

1. A firefighter gear cleaner system comprising:

a mobile vehicle having a PTO;

an electrical generator secured to said mobile vehicle and coupled to said PTO;

a potable water tank secured to said mobile vehicle, said water tank transfers potable water under pressure pass through a detection sensor to calculate pH, chlorine, and hardness level;

a sonic bath tank secured to said mobile vehicle and fluidly coupled to said portable water tank, said sonic bath tank having a water tight lid;

an ozone generator secured to said mobile vehicle and electrically coupled to said generator with ozone injected into said sonic bath tank;

a first gear extractor secured to said mobile vehicle, electrically coupled to said generator and fluidly coupled to said potable water tank with a first insertion pump coupled to said detection sensor to calculate the amount of cleaner material to be inserted based upon said calculated pH, chlorine, and hardness level of the potable water;

a tumble dryer sized to receive gear treated in said first gear extractor, said tumble dryer and a propane tank used to fuel a heater is secured to said mobile vehicle;

a second gear extractor secured to said mobile vehicle, electrically coupled to said generator and fluidly coupled to said potable water tank with a second insertion pump coupled to said detection sensor to calculate the amount of cleaner material to be inserted based upon said calculated pH, chlorine, and hardness level of the potable water, air in said first and second extractor is displaced with ozone from said ozone generator;

a hanger dryer secured to said mobile vehicle, said hanger dryer having a heater electrically coupled to said generator to provide low heat with a high velocity air flow through said dryer;

a gray water tank secured to said mobile vehicle and fluidly coupled to said sonic bath tank, said first extractor and said second extractor, said gray water tank coupled to said ozone generator and a filter to allow recycling of said fluid inserted through said sonic bath tank, said first extractor and said second extractor; and a holding tank secured to said mobile vehicle and fluidly coupled to said gray water tank, said holding tank holding contaminated fluid received from said gray water tank.

2. The firefighter gear cleaner apparatus according to claim 1 wherein said sonic bath tank includes a recirculation pump and a filter.

3. The firefighter gear cleaner apparatus according to claim 1 wherein said filter is 30 micron.

4. The firefighter gear cleaner apparatus according to claim 1 wherein said sonic bath tank includes removable baffles.

5. The firefighter gear cleaner apparatus according to claim 1 wherein said sonic bath tank is filled with 90% potable water admixed with about 10% cleaning solution, said sonic bath tank constructed and arranged to clean hard surfaced firefighter gear such as boots, helmets, hand tools and air packs.

6. The firefighter gear cleaner apparatus according to claim 1 wherein said injection ozone is through a bubbler unit positioned along the bottom of said sonic bath tank.

7. The firefighter gear cleaner apparatus according to claim 1 wherein said electrical generator is 60 KW.

8. The firefighter gear cleaner apparatus according to claim 1 wherein first gear extractor and said tumbler dryer are constructed and arranged to wash and dry the inner liners of said firefighter gear.

9. The firefighter gear cleaner apparatus according to claim 1 wherein said first insertion pump is wirelessly coupled to said detection sensor wherein said first insertion pump is operated in response to sensor inputs.

10. The firefighter gear cleaner apparatus according to claim 1 wherein second gear extractor and said hanger dryer are constructed and arranged to wash and dry the outer wear of firefighter gear.

11. The firefighter gear cleaner apparatus according to claim 1 wherein said hanger dryer is about 6 feet wide, 7 feet tall, and 3 feet deep and arranged to receive firefighting gear on a hanger.

12. The firefighter gear cleaner apparatus according to claim 1 wherein said potable water tank holds about 600 gallons of fluid.

13. The firefighter gear cleaner apparatus according to claim 1 wherein said gray water tank holds about 600 gallons of fluid.

14. The firefighter gear cleaner apparatus according to claim 1 wherein including an ozone bubbler unit secured to the bottom of said gray water tank and fluidly coupled to said ozone generator.

15. The firefighter gear cleaner apparatus according to claim 1 wherein said holding tank holds about 50 gallons of contaminated fluid.

* * * * *